United States Patent [19]

Eichfeld et al.

[11] 4,238,124

[45] * Dec. 9, 1980

[54] WORK HOLDER

[76] Inventors: Timothy J. Eichfeld; Horace C. Disston, both of 6730 Dewey Ave., Pennsauken, N.J. 08110

[ * ] Notice: The portion of the term of this patent subsequent to Feb. 20, 1996, has been disclaimed.

[21] Appl. No.: 6,095

[22] Filed: Jan. 24, 1979

Related U.S. Application Data

[63] Continuation-in-part of Ser. No. 907,093, May 18, 1978, Pat. No. 4,140,308.

[51] Int. Cl.[3] ..... B25B 1/00

[52] U.S. Cl. ..... 269/97; 269/166; 269/204

[58] Field of Search ..... 269/91, 94, 97, 87.3, 269/166, 204, 279–280, 282; 408/115, 109, 95, 97

[56] References Cited

U.S. PATENT DOCUMENTS

| | | | |
|---|---|---|---|
| 677,818 | 7/1901 | Thompson | 269/204 |
| 2,199,949 | 5/1940 | Davis | 269/166 |
| 2,866,367 | 12/1958 | Wilkes | 269/91 |
| 2,877,672 | 3/1959 | Roberts | 408/97 |
| 2,947,275 | 8/1960 | Edmonds | 269/166 |
| 3,033,559 | 5/1962 | Lindholm | 269/166 |
| 4,140,308 | 2/1979 | Disston et al. | 269/87.3 |

*Primary Examiner*—Robert C. Watson
*Attorney, Agent, or Firm*—Robert K. Youtie

[57] ABSTRACT

A work holder comprising a work engaging member having a work engaging face, a shaft generally normal to the work engaging face and a loose sleeve about the shaft carrying an outstanding arm and end jaw, the sleeve being contractible about the shaft for clamping a work piece between the jaw and work engaging member.

7 Claims, 5 Drawing Figures

FIG. 1
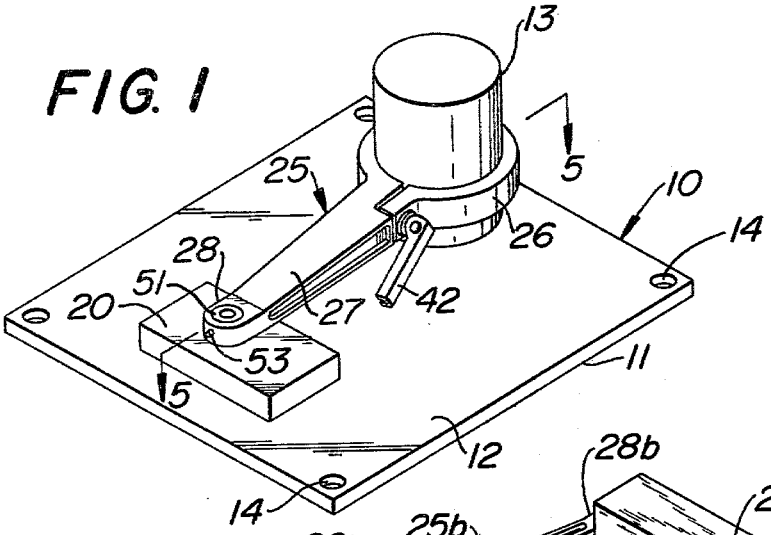
FIG. 2
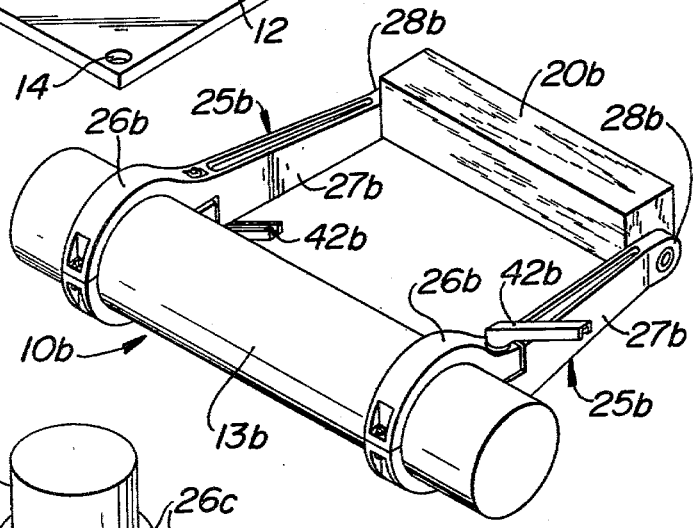
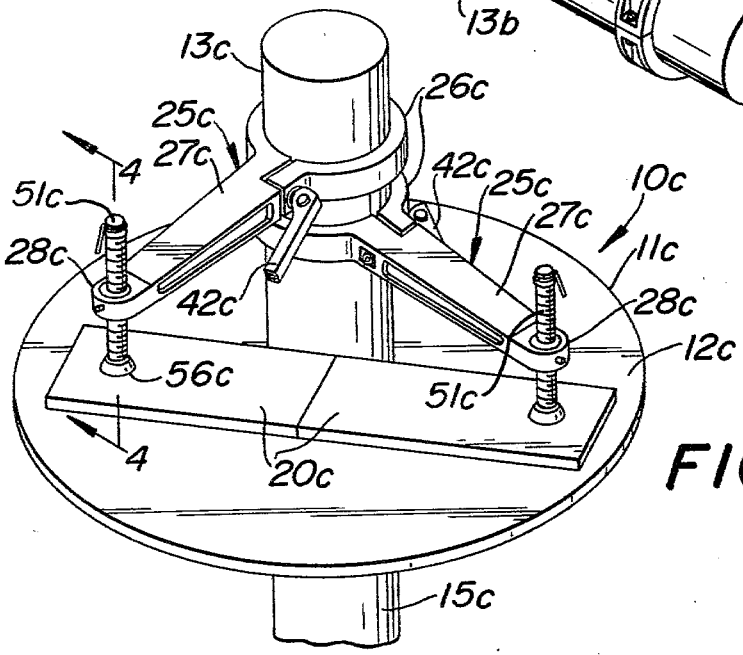
FIG. 3

FIG. 5
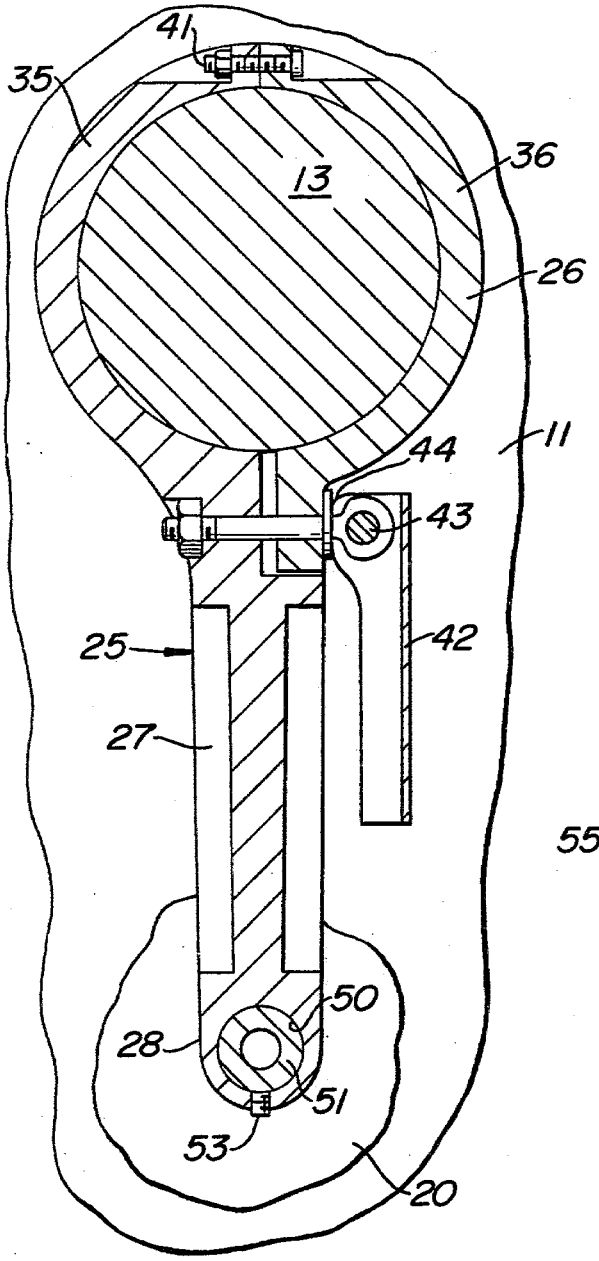
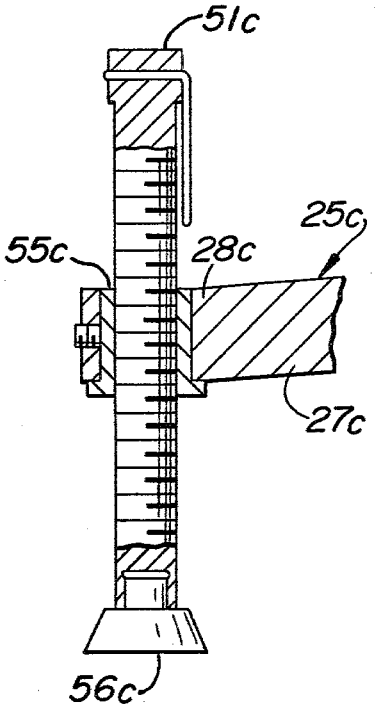
FIG. 4

WORK HOLDER

CROSS-REFERENCES TO RELATED APPLICATIONS

This application is a Continuation-In-Part application of our co-pending U.S. Pat. application Ser. No. 907,093, filed May 18, 1978 now U.S. Pat. No. 4,140,308, and entitled Work Hold-Down Improvements.

BACKGROUND OF THE INVENTION

The instant invention is concerned with work holders and related to the hold-down construction of our prior U.S. Pat. No. 4,025,064. This patent is the only relevant prior art known to applicants.

SUMMARY OF THE INVENTION

While the parent application includes a variety of embodiments for holding work of various configurations down on a tool table or bed, it is an object of the present invention to further enlarge the versatility and utility of work holders, permitting of quick and easy work holding with or without a work table or bench, as by clamping a work piece between elements of the work holder, as well providing a work holder for attachment to a bench, and further providing a work holder for welding and like procedures.

More particularly, it is an important object of the present invention to provide work holders in accordance with the teachings of the present invention wherein a pair of work engaging members are quickly engagable and releasable with respect to opposite faces of a work piece, wherein the work piece may be portable, if desired, by transport of the work holder; and further wherein a plurality of work engaging members are engagable with the same side of one or more work pieces to hold the same in fixed relation and against a common work engaging member for operations on the work pieces.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top plan view showing a work holder of the present invention adapted to be mounted to simple mounting means or transported, as desired.

FIG. 2 is a perspective view showing another embodiment of work holder of the present invention.

FIG. 3 is a perspective view showing still a further embodiment of work holder of the present invention, which may be particularly employed in welding procedures.

FIG. 4 is a partial section elevational view taken generally along the line 4—4 of FIG. 3.

FIG. 5 is a generally horizontal sectional view taken approximately along the line 5—5 of FIG. 1.

DESCRIPTION OF THE PREFERRED EMBODIMENTS

Referring now more particularly to the drawings, and specifically to FIG. 1 thereof, a work holder is there generally designated 10, and may include a work engaging member 11, such as a flat element or plate, having one face or side 12 for engagement with a work piece. Extending rigidly from the work engaging member 11, generally normal to and outstanding from the work engaging face 12, is an elongate post, column or shaft 13. As in the illustrated embodiment, the work engaging member or plate 11 may be generally rectangular, and the post or shaft 13 may upstand from the plate along one side edge thereof. Advantageously, the work engaging member or plate 11 may be provided with suitable mounting or securing means, such as holes 14 or other suitable means, say for receiving fasteners securing the plate to a desired support.

Illustrated in position on the work engaging face 12 of member 11 is a work piece 20, and associated with the post or shaft 13 and work piece is a work engaging member or hold-down, generally designated 25. The work engaging member or hold-down 25 may be essentially similar to the hold-down of U.S. Pat. No. 4,025,064, including an enlarged, open annular end portion or sleeve 26, best seen in FIG. 5, circumposed about column or shaft 13, and a generally radial extension or arm 27 projecting externally, generally radially from the sleeve to terminate in an end portion 28.

The sleeve 26 may be of split construction, including a generally semi-cylindrical sleeve part 35 extending integrally from arm 27, and an additional semi-cylindrical sleeve part 36 releasably connected to the sleeve part 35 for cooperation therewith to define a generally cylindrical internal surface in conforming clamping engagement about the shaft or post 13.

The sleeve parts 35 and 36 may be connected together at one pair of adjacent ends by suitable connector or tie means 41, and releasably connected together at their other pair of adjacent ends by lever means 42 selectively swingable about a pin 43 to rotate cam 44 and releasably contract the sleeve parts into binding engagement about the post 13. The work hold-down, as thus far described, may be essentially identical to that of prior U.S. Pat. No. 4,025,064.

The distal or outer end region 28 of arm 27 is provided with a generally vertical through hole 50 which may receive a portion of a work engager or presser 51 releasably retained in position by suitable means, such as a setscrew 53. The presser 51 may have its lower face engaging the work piece 20 to releasably clamp the latter between the presser and plate face 12, say the presser being of suitable material to engage and protect the work piece. Alternatively, the presser may be eliminated and the underside of arm end portion 28 define a work engaging face in direct clamping engagement with the work piece 20. Also, other presser types may be employed, as desired.

As described in said U.S. Pat. No. 4,025,064, the work engaging member 25 may have its sleeve 26 opened or released, as by swinging lever 42 counterclockwise from the position shown in FIG. 5. With the sleeve 26 loosened or released, the sleeve will fall downwardly on the post or shaft 13 to a tilted or canted condition, the arm 27 having its outer end 28 supported, either by the presser 51 or without the latter, on the work piece 20. Upon tightening or contracting of the splint sleeve 26, by generally clockwise rotation of lever 42, the arm 27 tends to have its outer end 28 swing downwardly for firm pressing, holding and clamping engagement with the work piece 20.

Thus, the work holder 10 may function in a manner generally similar to that of a vise, wherein the work engaging face 12 of plate 11 defines one, relatively fixed jaw, and the presser 51, or absent the presser the underside of arm end 28 defines the other, relatively movable work engaging jaw. The work piece 20 may be transported in its fixed condition relative to the work holder, being clamped thereby. Also, the work holder 10 may be fixed, or releasably fixed to a desired support, as by fasteners through openings 14, if desired.

In the embodiment shown in FIG. 2, a work holder is there generally designated **10*b*, and may include a shaft or post 13*b* which carries a pair of work engaging members 25*b* in respective clamping engagement with opposite faces of a work piece 20*b***.

The work engaging members **25*b* may be identical, if desired, and each essentially the same as the work engaging member 25** of the first described embodiment.

Thus, each work engaging member **25*b* includes an enlarged, open annular end portion or sleeve 26*b*, which sleeves are circumposed about spaced portions of shaft 13*b*. Extending generally radially from each sleeve 26*b*, in general parallelism with each other, is an extension or arm 27*b*, each of which terminates in an end or jaw portion 28*b*. The sleeves 26*b* may be of split construction having their internal dimensions contractible and expandible upon operation of levers 42*b*. Thus, each sleeve 26*b* may be opened to a degree with its internal dimension greater than the external dimension of the shaft 13*b* and loosely circumposed about the shaft for sliding therealong and tilting about a transverse axis between a longitudinal position relative to and slidable on the shaft, and a canted position jammed against outward movement along the shaft. Upon contraction of each sleeve 26*b* it is urged from its canted position relative to the shaft 13*b* toward its longitudinal position relative to the shaft. The arms 27*b* of the work engaging members 25*b* may, upon contraction of the sleeves 26*b* be urged toward each other to effectively clamp the work piece 20*b* between the jaws 28*b*. That is, the facing sides of the jaws 28*b* define work piece engaging faces for clamping engagement with the work piece 20*b***.

In this condition, as illustrated in FIG. 2, the work holder **10*b*, together with its held work piece 20*b***, may be transported and positioned as desired, without losing relative positioning therebetween.

Referring now to FIGS. 3 and 4, a further embodiment of work holder is there generally designated **10*c*, wherein a work engaging member 11*c* may be defined by a generally horizontally disposed table or plate, which may be suitably supported, as by a leg 15*c*. The work holder 10*c*** may be considered as a welding work piece holder with the parts thereof fabricated of suitably conductive material, say to ground the work, but may be otherwise if desired.

The work engaging member, plate or table **11*c* may include an upper face 12*c* for supporting engagement with the work, say a pair of work pieces 20*c* to be welded together. Upstanding from the work engaging member or table 11*c* may be a generally cylindrical post or shaft 13*c*, substantially normal to the work engaging table face 12*c***.

A pair of work engaging members **25*c* may be associated with the upstanding column or shaft 13*c*, in generally the same manner as the work engaging member 25 with respect to shaft 13 of the first described embodiment. If desired, additional work engaging members 25*c* may be provided on shaft 13*c*; and also, additional upstanding shafts 13*c* may be provided on work engaging member or plate 11*c***.

The work engaging members **25*c* similarly each include a contractile and expansile sleeve 26*c* circumposed about the shaft 13*c* and each provided with-an operating lever 42*c*** for effecting loosening expansion and tightening contraction of the of the respective sleeve.

Projecting radially externally from each sleeve **26*c* is an extension or arm 27*c* which terminates in an outer end or jaw portion 28*c***.

If desired, the arm end portions **28*c* may each be provided with a generally vertical, internally threaded bushing 55*c* carrying an elongate externally threaded shank or presser 51*c* provided on its lower end with a foot or jaw 56*c***.

As in the first described embodiment of FIGS. 1 and 5, the work engaging members **25*c* may each have its sleeve 26*c* open, expanded or released by swinging appropriate lever 42*c*, such that the sleeves 26*c* will fall on the shaft 13*c* to a tilted or canted position with the pressers 51*c* on the work pieces 20*c*. Upon tightening, contracting or clamping of the spit sleeves 26*c*, by operation of levers 42*c*, the arms 27*c* have their outer ends urged downwardly for firm pressing and holding engagement of the pressers 51*c* with the work pieces 20*c*. The threaded engagement of the pressers 51*c* in arm end portions 28*c* serves both to provide a desired vertical positioning of the arms 27*c*, and further to permit of additional clamping pressure by rotation of the pressers after tightening of the sleeves. The work pieces 20*c* will therefore be firmly held in position relative to each other for a desired welding or other procedure. Of course, the work pieces 20*c*** may be arranged with respect to each other in any desired manner, as required for operation thereon.

From the foregoing, it is seen that the present invention provides unique improvements in work holders, which further enhances versatility in use while maintaining easy and quick acting operation.

Although the present invention has been described in some detail by way of illustration an example for purposes of clarity of understanding, it is understood that certain changes and modifications may be made within the spirit of the invention.

What is claimed is:

1. A work holder comprising a work engaging member, a work engaging face on said work engaging member, a cylindrical shaft extending generally normal to said work engaging face, a sleeve on said shaft having a generally cylindrical internal configuration and an internal dimension greater than the external dimension of said shaft, said sleeve being loosely circumposed about said shaft for sliding therealong and tiltable about a transverse axis between a longitudinal position relative to and slidable on said shaft and a canted position jammed against movement along said shaft, said sleeve having articulated sections releasably contractible about said shaft to urge the sleeve from is canted position toward its longitudinal position, an arm extending rigidly from said sleeve for movement therewith between an initial outstanding position projecting transversely of said shaft and a final outstanding position swung at an angle to said initial outstanding position upon sleeve movement between respective longitudinal and canted positions, and a jaw on said arm spaced from said sleeve and facing toward said work engaging face, said jaw being engageable with a work piece engaging said work engaging face in the final outstanding arm position to releasably clamp the work piece against said work engaging face upon contraction of said flange.

2. A work holder according to claim 1, said work engaging member comprising a plate, and said work engaging face comprising a face of said plate.

3. A work holder according to claim 2, in combination with securing means for fastening said plate to a support.

4. A work holder according to claim 2, said securing means comprising fastener receiving means.

5. A work holder according to claim 2, in combination with leg means supporting said plate in elevated relation and combining therewith to define a work bench.

6. A work holder according to claim 1, said work engaging member comprising an additional sleeve having an internal dimension greater than the external dimension of and loosely circumposed about said shaft for sliding therealong and tiltable about a transverse axis between a longitudinal position relative to and slidable on said shaft and a canted position jammed against upward movement along the shaft, said additional sleeve being releasably contractible about said shaft to urge the additional sleeve from its canted position toward its longitudinal position, and additional arm extending from said additional sleeve for movement therewith between an initial outstanding position and a final outstanding position swung at an angle to said initial outstanding position upon additional sleeve movement between respective longitudinal and canted positions, and an additional jaw on said additional arm spaced from said additional sleeve, said work engaging face being on said additional jaw.

7. A work holder according to claim 2, in combination with an additional sleeve on said shaft and having an internal dimension greater than the external dimension of and loosely circumposed about said shaft for sliding therealong and tiltable about a transverse axis between a longitudinal position relative to and slidable on said shaft and a canted position jammed against outward movement along the shaft, said additional sleeve being releasably contractible about said shaft to urge said additional sleeve from its canted position toward its longitudinal position, an additional arm extending from said sleeve for movement therewith between an initial outstanding position and a final outstanding position swung at an angle to said initial outstanding position upon sleeve movement between respective longitudinal and canted positions, and an additional jaw on said additional arm spaced from said addition sleeve and facing toward said work engaging face, said additional jaw being engageable with a work piece engaging said work engaging face in the outwardly swung additional arm position to releasably clamp the work piece against said work engaging face upon contraction of said additional sleeve.

* * * * *